US010333262B2

(12) United States Patent
Wang et al.

(10) Patent No.: US 10,333,262 B2
(45) Date of Patent: Jun. 25, 2019

(54) SOCKET

(71) Applicant: BOE TECHNOLOGY GROUP CO., LTD., Beijing (CN)

(72) Inventors: Hong Wang, Beijing (CN); Weiqing Guo, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/544,812

(22) PCT Filed: Feb. 27, 2017

(86) PCT No.: PCT/CN2017/074977
§ 371 (c)(1),
(2) Date: Jul. 19, 2017

(87) PCT Pub. No.: WO2017/202093
PCT Pub. Date: Nov. 30, 2017

(65) Prior Publication Data

US 2019/0115698 A1 Apr. 18, 2019

(30) Foreign Application Priority Data

Feb. 27, 2017 (CN) ..... 2016 2 0478603 U

(51) Int. Cl.
*H01R 13/11* (2006.01)
*H01R 13/518* (2006.01)
(Continued)

(52) U.S. Cl.
CPC ..... *H01R 13/7037* (2013.01); *H01R 13/642* (2013.01); *H01R 13/112* (2013.01); *H01R 13/113* (2013.01); *H01R 13/518* (2013.01)

(58) Field of Classification Search
CPC ..... H01R 13/7032; H01R 13/7031; H01R 13/6205; H01R 13/7073; H01R 13/642;
(Continued)

(56) References Cited

U.S. PATENT DOCUMENTS 3,144,527 A * 8/1964 Tolegian ..... H01J 5/54 200/51.09
4,317,969 A * 3/1982 Riegler ..... H01R 13/6205 200/52 R
(Continued)

FOREIGN PATENT DOCUMENTS

CN 2534694 Y 2/2003
CN 201298627 Y 8/2009
(Continued)

OTHER PUBLICATIONS

International Search Report and Written Opinion for Application No. PCT/CN2017/074977, dated May 17, 2017, 8 Pages.

*Primary Examiner* — Gary F Paumen
(74) *Attorney, Agent, or Firm* — Brooks Kushman P.C.

(57) ABSTRACT

The present disclosure provides a socket for cooperating with a magnetically conductive prong to provide a power supply connection. The socket includes: an electrically conductive contact member for receiving the magnetically conductive prong; a spring sheet body, a first end of the spring sheet body being fixed, and a second end of the spring sheet body being provided with a magnetic component at a position corresponding to the electrically conductive contact member; a power supply connecting portion for connecting with a power supply; and a first electrically conductive portion being arranged on the spring sheet body and located at a position corresponding to the power supply connecting portion, the first electrically conductive portion being located between the first end of the spring sheet body and the second end of the spring sheet body, and the first electrically
(Continued)

conductive portion and the power supply connecting portion being connected through an electrically conductive connecting wire.

13 Claims, 3 Drawing Sheets

(51) Int. Cl.
*H01R 13/642* (2006.01)
*H01R 13/703* (2006.01)

(58) Field of Classification Search
CPC .. H01R 13/518; H01R 13/113; H01R 13/112; H01R 11/30; H01R 2103/00; H01F 7/0242
USPC ..... 439/38, 39, 188; 335/202, 205
See application file for complete search history.

(56) References Cited

U.S. PATENT DOCUMENTS

| | | | | | |
|---|---|---|---|---|---|
| 4,844,582 | A * | 7/1989 | Giannini | G02B 6/3817 | 385/57 |
| 5,829,987 | A * | 11/1998 | Fritsch | H01R 13/7037 | 439/38 |
| 5,921,783 | A * | 7/1999 | Fritsch | H01R 13/703 | 439/38 |
| 6,565,363 | B2 * | 5/2003 | Downing | H01R 13/6205 | 439/38 |
| 6,623,276 | B2 * | 9/2003 | Dalmau Ferrerfabrega | H01R 13/6205 | 335/205 |
| 6,966,781 | B1 * | 11/2005 | Bullinger | H01R 13/6205 | 439/289 |
| 7,045,723 | B1 * | 5/2006 | Projkovski | H01R 13/7035 | 200/51.09 |
| 7,445,452 | B1 * | 11/2008 | Wu | H01R 13/6205 | 439/39 |
| 7,497,693 | B1 * | 3/2009 | Wu | H01R 13/2442 | 439/39 |
| 8,734,165 | B2 * | 5/2014 | Neel | H01R 11/30 | 439/39 |
| 9,130,317 | B2 * | 9/2015 | Wang | H01R 13/6683 | |
| 9,190,782 | B2 * | 11/2015 | King | H01R 13/713 | |
| 9,899,762 | B2 * | 2/2018 | Levine | H01R 13/703 | |
| 10,038,283 | B2 * | 7/2018 | Oddsen | H01R 13/652 | |
| 2003/0045134 | A1 * | 3/2003 | Downing | H01R 13/6205 | 439/38 |
| 2007/0072443 | A1 * | 3/2007 | Rohrbach | H01R 13/6205 | 439/39 |
| 2008/0096398 | A1 * | 4/2008 | Rohrbach | H01R 13/6205 | 439/39 |

FOREIGN PATENT DOCUMENTS

| | | | |
|---|---|---|---|
| CN | 102403628 | A | 4/2012 |
| CN | 101834378 | B | 5/2012 |
| CN | 203242806 | U | 10/2013 |
| CN | 105006712 | A | 10/2015 |
| CN | 204809510 | U | 11/2015 |
| CN | 204947216 | U | 1/2016 |
| CN | 205212101 | U | 5/2016 |
| CN | 205790773 | U | 12/2016 |
| FR | 2644301 | A1 | 9/1990 |
| JP | 2010205570 | A | 9/2010 |

* cited by examiner

SOCKET

CROSS-REFERENCE TO RELATED APPLICATIONS

This application is the U.S. national phase of PCT Application No. PCT/CN2017/074977 filed on Feb. 27, 2017, which claims priority to Chinese Patent Application No. 201620478630.7 filed May on 24, 2016, the disclosures of which are incorporated in their entirety by reference herein.

TECHNICAL FIELD

The present disclosure relates to the field of electronic technology, and in particularly to a socket.

BACKGROUND

At present, household electricity is the 220V alternating-current power supply, and an incorrect usage or a careless touching of a socket of a household electrical appliance may probably pose an electrical shock hazard. Particularly in case of children being at home, more attentions should be paid on managements and usages of the socket.

SUMMARY

In view of this, the present disclosure provides a socket to provide a higher degree of safety.

On the basis of the object described above, provided by the present disclosure is a socket for cooperating with a magnetically conductive prong to provide a power supply connection, including:

an electrically conductive contact member for receiving and contacting the magnetically conductive prong;

a spring sheet body, a first end of the spring sheet body being fixed, and a second end of the spring sheet body being provided with a magnetic component at a position corresponding to the electrically conductive contact member;

a power supply connecting portion for connecting with a power supply; and a first electrically conductive portion being arranged on the spring sheet body and located at a position corresponding to the power supply connecting portion, the first electrically conductive portion being located between the first end of the spring sheet body and the second end of the spring sheet body, and the first electrically conductive portion and the electrically conductive contact member being connected through an electrically conductive connecting wire.

Optionally, in the event that the magnetically conductive prong is completely inserted into the electrically conductive contact member, the magnetically conductive prong and the electrically conductive contact member are in contact with each other; the magnetically conductive prong attracts the magnetic component to drive the spring sheet body to move such that the power supply connecting portion and the first electrically conductive portion are in contact with each other.

Optionally, a ratio of a distance between the first electrically conductive portion and the first end to a distance between the magnetic component and the first electrically conductive portion is less than a set value.

Optionally, the set value is 1.

Optionally, the electrically conductive contact member includes a limiting passageway for limiting a position of the magnetically conductive prong to enable the magnetically conductive prong to slide inward to a position corresponding to the magnetic component along the limiting passageway after the magnetically conductive prong is inserted into the socket.

Optionally, the limiting passageway includes a limiting opening and a clamping portion having a prong passageway, and the clamping portion, the limiting opening and the magnetic component are positioned such that the magnetically conductive prong reaches the position corresponding to the magnetic component after passing through the clamping portion and the limiting opening to attract the magnetic component.

Optionally, the prong passageway has a prong entrance narrowing from outside to inside.

Optionally, the socket further includes a fixing plate, the spring sheet body is elastic, and the first end of the spring sheet body is fixed on the fixing plate through a fastener.

Optionally, the first end of the spring sheet body is connected to a spring, and the spring is fixed on the fixing plate through a fastener.

Optionally, the socket further includes a second electrically conductive portion being arranged on the power supply connecting portion and protruding from the power supply connecting portion.

According to the socket provided by the present disclosure, a magnetic component is mounted inside the socket at a portion for combining with the prong, and on an extension of the line connecting the portion where the socket is combined with the prong and an end where the power supply is located, the spring sheet body is arranged on a position nearer to the power supply to form a single-point lever which uses a fixed end as a pivot point, and in the event that the prong is completely inserted, the magnetic component attracts the prong, so that the power supply end and the socket are connected and thus the plug is energized. Since the power supply end is nearer to the origin of the lever, the magnetic component enables the prong to be attracted without too large force. Moreover, the prong has to be completely inserted in order to make the circuit between the plug and the socket to be turned on, thus avoiding an electric shock when children contact the socket with their hands.

DETAILED DESCRIPTION

In order to make the technical problems, the technical solutions and the advantages of the present disclosure more apparent, the specific embodiments of the present disclosure will be described hereinafter in detail in conjunction with the drawings and embodiments of the present disclosure.

Figure 1:
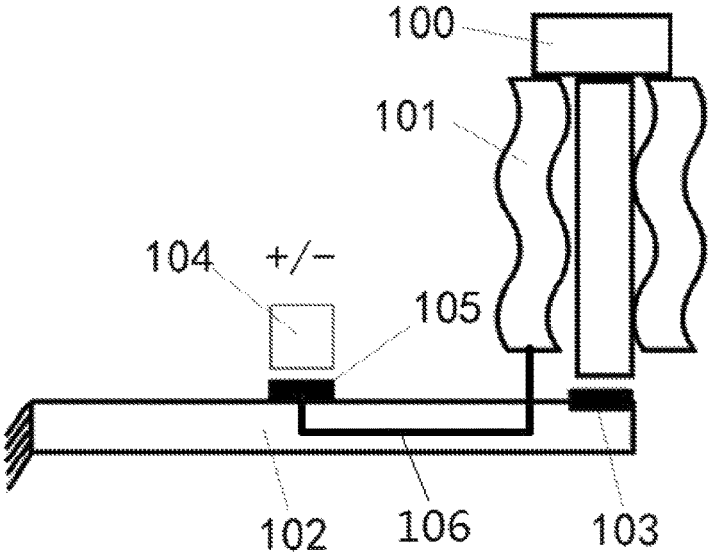
FIG. 1 is a schematic diagram showing a structure of a socket provided by the embodiments of the present disclosure.

Firstly, the present disclosure provides a socket for cooperating with a magnetically conductive prong to provide a power supply connection. The structure thereof is as shown in FIG. 1, including:

an electrically conductive contact member 101 for receiving the magnetically conductive prong 100, the electrically conductive contact member 101 being in contact with the magnetically conductive prong 100 under the state where the magnetically conductive prong 100 is inserted;

a spring sheet body 102, a first end of the spring sheet body 102 being fixed inside the socket, and a second end of the spring sheet body 102 being provided with a magnetic component 103 at a position corresponding to the electrically conductive contact member 101;

a power supply connecting portion 104 for connecting with a power supply; and a first electrically conductive portion 105 being arranged on the spring sheet body 102 and located at a position corresponding to the power supply connecting portion 104, the first electrically conductive portion 105 being located between the first end of the spring sheet body 102 and the second end of the spring sheet body 102, and the first electrically conductive portion 105 and the electrically conductive contact member 101 being connected through an electrically conductive connecting wire 106.

In can be seen from the above that, the socket provided by the present disclosure is capable of enabling the first electrically conductive portion to be connected to the power supply connecting portion after the magnetic component of the second end of the spring sheet body is attracted by the magnetically conductive prong, such that the circuit formed by the power supply, the power supply connecting portion, the first electrically conductive portion, the electrically conductive connecting wire, the electrically conductive contact member and the prong is turned on to supply power for the prong. When the magnetic component does not attract the magnetically conductive prong, the circuit is not turned on, thus improving the safety of the socket. Meanwhile, the first electrically conductive portion and the power supply connecting portion are located between the first end of the spring sheet body and the second end of the spring sheet body, therefore the magnetic component and the magnetically conductive prong enable the first electrically conductive portion to be in contact with the power supply connecting portion without a too large attracting force, thus lowering a design difficulty and reducing requirements on the magnetically conductive component.

In some embodiments of the present disclosure, in the event that the magnetically conductive prong is completely inserted into the electrically conductive contact member, the magnetically conductive prong and the magnetic component are in contact with each other to drive the spring sheet body to move such that the power supply connecting portion and the first electrically conductive portion are in contact with each other.

In some specific embodiments of the present disclosure, the electrically conductive contact member refers to a socket contact member having an electric conductivity for contacting the prong to supply an electric energy for the prong directly.

In some specific embodiments of the present disclosure, still referring to FIG. 1, the electrically conductive contact member 101 is an electrically conductive component. A length of the electrically conductive contact member 101 is less than a length of the magnetically conductive prong 100, such that an end portion of the magnetically conductive prong 100 may go beyond the electrically conductive contact member 101 when the magnetically conductive prong 100 is completely inserted into the electrically conductive contact member 101.

In some embodiments of the present disclosure, a ratio of a distance between the first electrically conductive portion and the first end to a distance between the magnetic component and the first electrically conductive portion is less than a set value. The shorter the distance between the first electrically conductive portion and the first end is, the smaller the movement distance of the spring sheet body required for the contacting of the power supply connecting portion with the first electrically conductive portion is.

In some embodiments of the present disclosure, the set value is 1. According to the lever principle, assuming an attracting force for the magnetic component to contact the magnetically conductive prong is F1, a force required for a connection between the first electrically conductive portion and the power supply connecting portion is F2, a length of the spring sheet body is L1, and a distance between the first electrically conductive portion and the first end is L2, then according to formula $F1 \times L1 = F2 \times L2$, in case that F2 is constant, as a ratio of L1 to L2 increases, a value that F1 needs to be reached is getting smaller, thus enabling the magnetically conductive prong to be in contact with the magnetic component easily and turning on the circuit including the power supply, the first electrically conductive portion, the electrically conductive contact member and the power supply, and the power supply is connected with the plug. Therefore, in some optional embodiments of the present disclosure, it is ensured that the ratio of the distance between the first electrically conductive portion and the first end to the distance between the magnetic component and the first electrically conductive portion is less than 1, and the ratio may be adjusted as needed. Therefore, in the case of the attracting force and the material of the magnetic component being constant, a relatively smaller volume may be selected to reduce the weight and cost of a key portion of the magnetic component.

Figure 2:
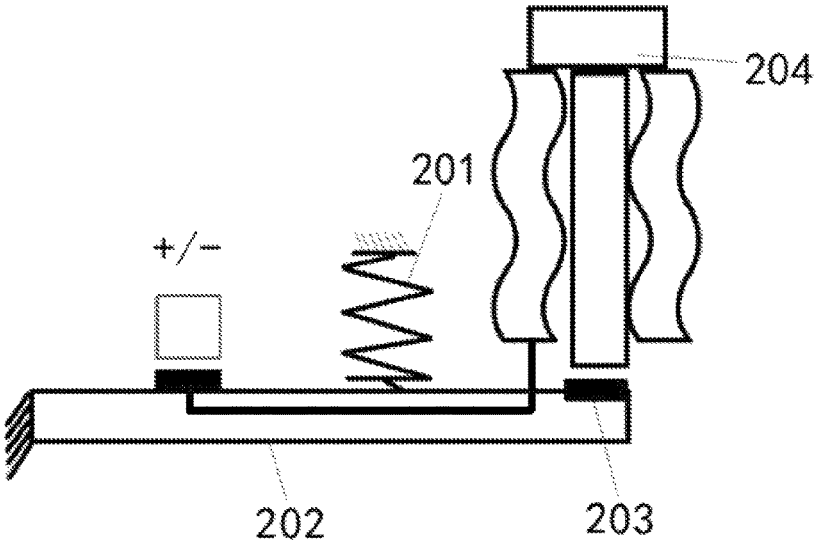
FIG. 2 is another schematic diagram showing a structure of a socket provided by the embodiments of the present disclosure.

In a specific embodiment of the present disclosure, considering that the spring sheet body has a certain weight in itself, a spring sheet body limiting member may be arranged. For example, as shown in FIG. 2, the spring sheet body limiting member is a stretchable spring 201 for limiting a position of the spring sheet body 202 such that the spring sheet body 202 does not sag or deviate due to the weight of its own and the like and then results in that the magnetic component 203 is too far away from the magnetically conductive prong 204 to attract and contact the magnetically conductive prong when the magnetically conductive prong 204 is inserted.

Still referring to FIG. 1, after the magnetically conductive prong 100 is in contact with the magnetic component 103, because of an impact of the lever, only when the power supply connecting portion 104 connected with the power supply is connected to the first electrically conductive portion 105 below, the electrically conductive connecting wire on the spring sheet body 102 inside the socket is energized, and the contacted plug is energized. According to the lever principle, the power supply may be turned on without a too large force between the magnetically conductive prong 100 of the plug and the magnetic component 103, therefore not requiring a large force for pulling out the plug, which is easier for users to use. When in the absence of plug, there is also no attraction between the magnetically conductive prong 100 and the magnetic component 103, and since the first electrically conductive portion 105 is not in contact with the power supply connecting portion 104, the electrically conductive connecting wire on the spring sheet body 102 inside of the socket is not energized, thus avoiding electric shocks when accidentally contacting the socket.

In some embodiments of the present disclosure, the electrically conductive contact member includes a limiting passageway for limiting a position of the magnetically conductive prong to enable the magnetically conductive prong to slide inward to a position corresponding to the magnetic component along the limiting passageway after the magnetically conductive prong is inserted into the socket.

In some embodiments of the present disclosure, the socket further includes a fixing plate, the limiting passageway includes a limiting opening and a clamping portion having a prong passageway, and the clamping portion, the limiting opening and the magnetic component are positioned such that the magnetically conductive prong reaches the position corresponding to the magnetic component after passing through the clamping portion and the limiting opening to attract the magnetic component.

Figure 3:
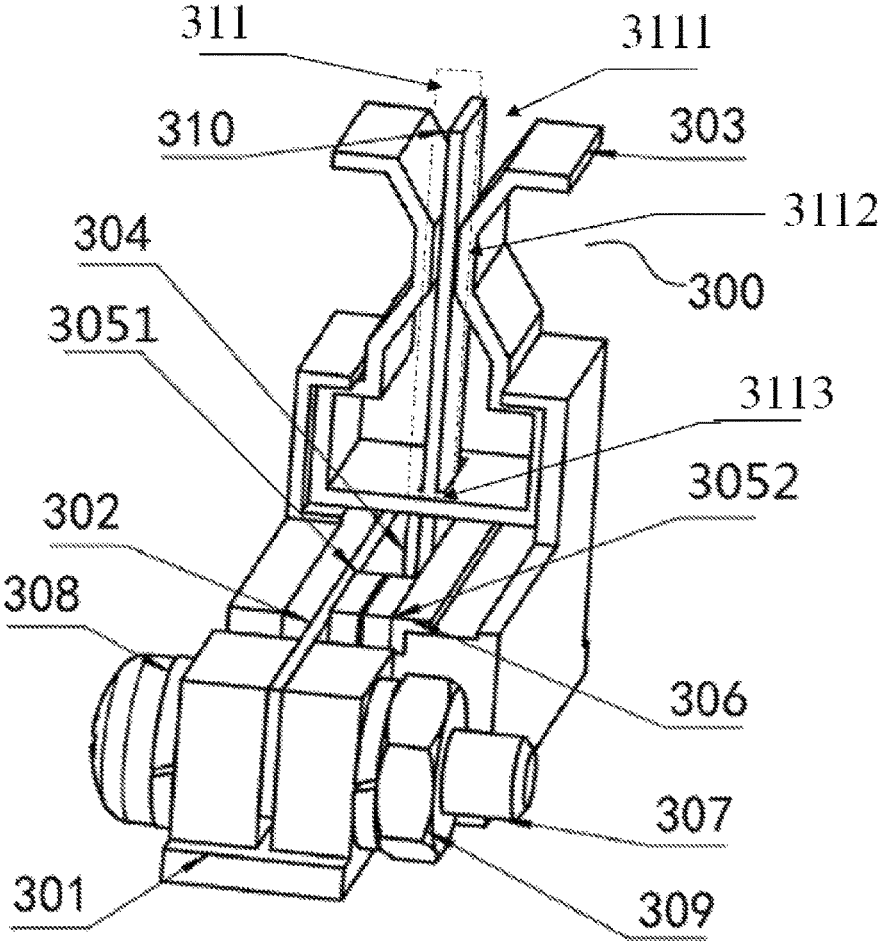
FIG. 3 is yet another schematic diagram showing a structure of a socket provided by the embodiments of the present disclosure.

In FIG. 3, the dashed lines show a limiting passageway 311 of the socket according to the embodiment of the present disclosure, including a clamping portion 3112 and a limiting opening 3113.

When a prong having an abnormal-shaped section is being inserted, the limiting opening prevents the prong from inserting to a certain extent to improve safety.

In some embodiments of the present disclosure, the prong passageway has a prong entrance narrowing from outside to inside, which facilitates the magnetically conductive prong to be inserted. FIG. 3 schematically shows a prong entrance 3111 according to the embodiment of the present disclosure.

When a non-magnetically conductive material is inserted, it is unable to attract and contact the magnetic component, and the first electrically conductive portion and the power supply connecting portion are not in contact with each other, thus ensuring the safety of the socket.

In some embodiments of the present disclosure, the socket further includes a fixing plate, the spring sheet body is elastic, and the first end of the spring sheet body is fixed on the fixing plate through a fastener. The fastener may be a bolt, a screw etc. The spring sheet body may also be fixed on the fixing plate by means of adhesion or soldering etc. If the spring sheet body is elastic, the spring sheet body plays the roles of both a spring and a lever, that is, it plays a role of a spring as well as a lever, which not only effectively reduces the quantity of used materials and the production management costs as well as the weight, the volume and the cost of the product, but also improves the reliability of the product.

In some embodiments of the present disclosure, the first end of the spring sheet body is connected to a spring, and the spring is fixed on the fixing plate through a fastener.

In some embodiments of the present disclosure, the socket further includes a second electrically conductive portion being arranged on the power supply connecting portion and protruding from the power supply connecting portion.

Figure 4:
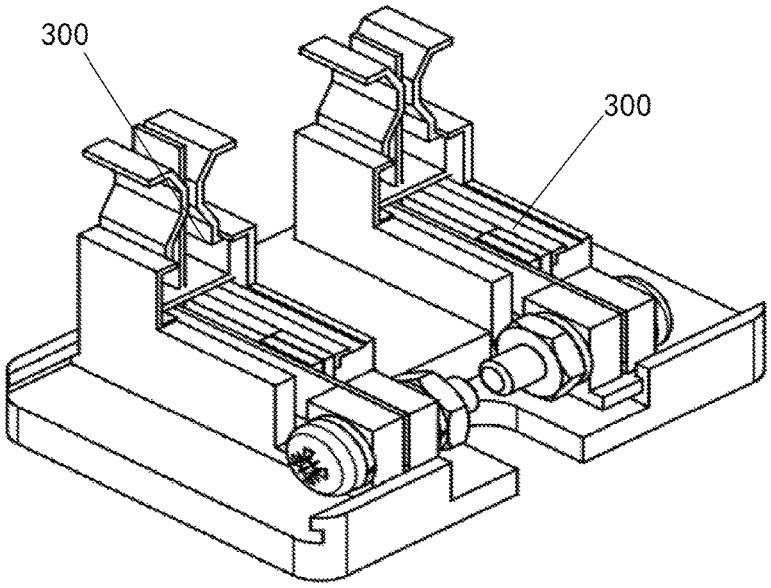
FIG. 4 is a schematic diagram showing a structure of a socket assembly provided by the embodiments of the present disclosure.
Figure 5:
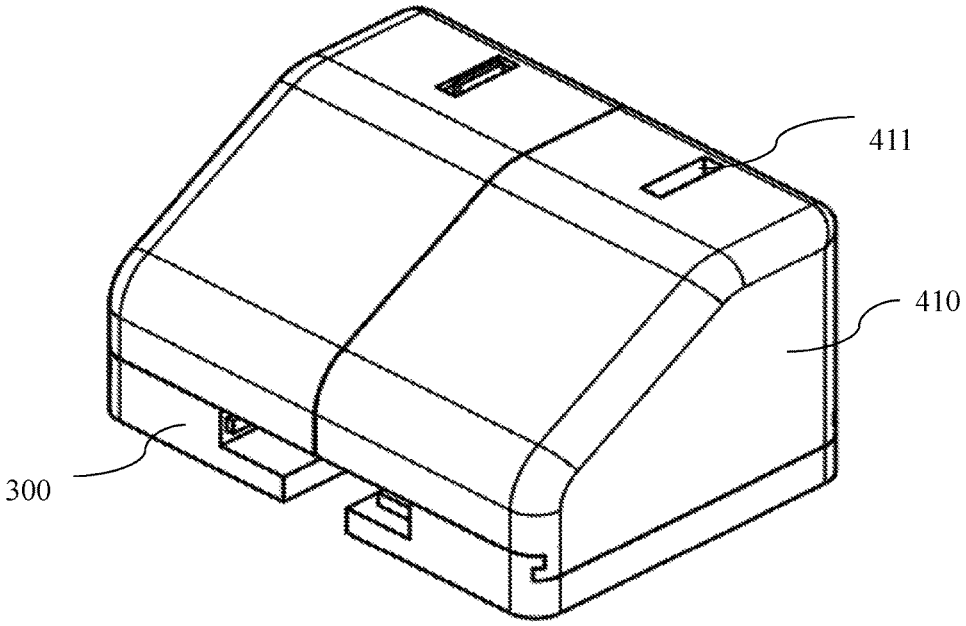
FIG. 5 is a schematic diagram showing a casing of a socket provided by the embodiments of the present disclosure.

In a specific embodiment of the present disclosure, the socket includes a socket assembly 300 as shown in FIG. 3. The socket assembly includes a fixing plate 301, a spring sheet body 302, an electrically conductive contact member 303, a magnet 304 (i.e., the above-mentioned magnetic component), a first electrically conductive portion 3051, a second electrically conductive portion 3052, a power supply connecting portion 306, a screw 307, a spring washer 308 and a nut 309. The fixing plate 301 is provided with a groove for fixing the first end of the spring sheet body 302 in the groove by using the nut 309, the screw 307 and the spring washer 308, and an external electric wire runs between the screw 307 and the spring washer 308 to maintain the power supply. The first electrically conductive portion 3051 and the second electrically conductive portion 3052 are fixed on a middle position of the spring sheet body 302 and the power supply connecting portion 306 respectively and correspond to each other. The electrically conductive contact member 303 is provided with a groove, a size of which corresponds to a cross section of the magnetically conductive prong 310 of the plug to ensure that other objects cannot pass through. The magnet 304 is fixed at the second end of the spring sheet body 302 by means of soldering or adhesion. The electrically conductive contact member 303 is fixed on the fixing plate 301 through a slot, and maintains contact with the first electrically conductive portion 3051. When the magnetically conductive prong 310 is completely inserted, the magnet 304 attracts the magnetically conductive prong 310, and because of the lever, the first electrically conductive portion 3051 contacts the second electrically conductive portion 3052, therefore the spring sheet body 302, the first electrically conductive portion 3051, the second electrically conductive portion 3052, the power supply connecting portion 306, the electrically conductive contact member 303 and the magnetically conductive prong 310 form a turned-on circuit, and a voltage across the screw 307 and the spring washer 308 is identical to a voltage across the electrically conductive contact member 3033. In a specific application, the socket may include one or more socket assemblies 300 as shown in FIG. 3. As shown in FIG. 4, in a specific embodiment, the socket includes two socket assemblies 300 as shown in FIG. 3, and is covered by a casing 410 as shown in FIG. 5, such that the two prongs of the plug are inserted into the two socket assemblies 300 from the openings 411 of the casing respectively.

According to the socket provided by the present disclosure, a magnetic component is mounted inside the socket at a portion for combining with the prong, and on an extension of the line connecting the portion where the socket is combined with the prong and an end where the power supply is located, the spring sheet body is arranged on a position nearer to the power supply to form a single-point lever which uses a fixed end as a pivot point, and in the event that the prong is completely inserted, the magnet attracts the prong, the power supply connecting portion and the first electrically conductive portion are in contact, and the power supply and the socket are connected, and thus the plug is energized. Since the power supply end is nearer to the origin of the lever, the magnetic component enables the prong to be attracted without a too large force. Moreover, the prong has to be completely inserted in order to make a circuit between the plug and the socket to be turned on, thus avoiding an electric shock when children contact the socket with their hands.

In should be understood that, the plurality of embodiments described in the specification is merely used to illustrate and explain, rather than to limit, the present disclosure. Moreover, the embodiments in the present application and features in the embodiments may be combined with each other on a non-conflicting basis.

Apparently, a person skilled in the art may make modifications and variations without departing from the principle and the scope of the present disclosure. Therefore, if these modifications and variations are within the scope of the claims of present disclosure and the equivalents thereof, the present disclosure is intended to include these modifications and variations.

What is claimed is:

1. A socket for cooperating with a magnetically conductive prong to provide a power supply connection, the socket comprising:

an electrically conductive contact member for receiving and contacting the magnetically conductive prong;

a spring sheet body, a first end of the spring sheet body being fixed, and a second end of the spring sheet body being provided with a magnetic component at a position corresponding to the electrically conductive contact member;

a power supply connecting portion for connecting with a power supply; and a first electrically conductive portion being arranged on the spring sheet body and located at a position corresponding to the power supply connecting portion, the first electrically conductive portion being located between the first end of the spring sheet body and the second end of the spring sheet body, and the first electrically conductive portion and the electrically conductive contact member being connected through an electrically conductive connecting wire.

2. The socket according to claim 1, wherein in the event that the magnetically conductive prong is completely inserted into the electrically conductive contact member, the magnetically conductive prong and the electrically conductive contact member are in contact with each other; the magnetically conductive prong attracts the magnetic component to drive the spring sheet body to move such that the power supply connecting portion and the first electrically conductive portion are in contact with each other.

3. The socket according to claim 2, wherein a ratio of a distance between the first electrically conductive portion and the first end to a distance between the magnetic component and the first electrically conductive portion is less than a set value.

4. The socket according to claim 3, wherein the set value is 1.

5. The socket according to claim 1, wherein the electrically conductive contact member comprises a limiting passageway for limiting a position of the magnetically conductive prong to enable the magnetically conductive prong to slide inward to a position corresponding to the magnetic component along the limiting passageway after the magnetically conductive prong is inserted into the socket.

6. The socket according to claim 5, wherein the limiting passageway comprises a limiting opening and a clamping portion having a prong passageway, and the clamping portion, the limiting opening and the magnetic component are positioned such that the magnetically conductive prong reaches the position corresponding to the magnetic component after passing through the clamping portion and the limiting opening to attract the magnetic component.

7. The socket according to claim 5, wherein the prong passageway has a prong entrance narrowing from outside to inside.

8. The socket according to claim 1, further comprising a fixing plate, wherein the spring sheet body is elastic, and the first end of the spring sheet body is fixed on the fixing plate.

9. The socket according to claim 1, further comprising a fixing plate, the first end of the spring sheet body is connected to a spring, and the spring is fixed on the fixing plate through a fastener.

10. The socket according to claim 1, further comprising a second electrically conductive portion being arranged on the power supply connecting portion and protruding from the power supply connecting portion.

11. The socket according to claim 8, wherein the first end of the spring sheet body is fixed on the fixing plate through a fastener.

12. The socket according to claim 1, further comprising a spring sheet body limiting member, wherein the spring sheet body limiting member and the spring sheet body are connected to each other to limit a position of the spring sheet body.

13. The socket according to claim 12, wherein the spring sheet body limiting member comprises a spring.

* * * * *